US006034657A

United States Patent [19]

Tokunaga et al.

[11] Patent Number: 6,034,657

[45] Date of Patent: Mar. 7, 2000

[54] PLASMA DISPLAY PANEL

[75] Inventors: Tsutomu Tokunaga; Hiroyuki Ajiki, both of Yamanashi-ken, Japan

[73] Assignee: Pioneer Electronic Corp., Tokyo, Japan

[21] Appl. No.: 08/988,470

[22] Filed: Dec. 10, 1997

[30] Foreign Application Priority Data

Dec. 27, 1996 [JP] Japan ..... 8-358886

[51] Int. Cl.[7] ..... G09G 3/28

[52] U.S. Cl. ..... 345/60; 340/71; 340/72

[58] Field of Search ..... 345/60, 63, 64, 345/66, 67, 71, 72, 74, 76, 77; 313/500, 505, 506, 484; 315/169.1, 169.3, 169.4

[56] References Cited

U.S. PATENT DOCUMENTS 4,874,986 10/1989 Menn et al. ..... 345/76

4,924,144 5/1990 Menn et al. ..... 345/76

5,570,104 10/1996 Hayashi ..... 345/60

*Primary Examiner*—Regina Liang

*Attorney, Agent, or Firm*—Nikaido Marmelstein Murray & Oram LLP

[57] ABSTRACT

A plasma display panel includes a front substrate; a plurality of row electrodes provided on an inner surface of the front substrate; a dielectric layer provided on the inner surface of the front substrate so as to cover the row electrodes; a rear substrate spaced apart from the front substrate to form a discharge space therebetween; a plurality of column electrodes provided on an inner surface of the rear substrate; a fluorescent material layer covering the column electrodes, the fluorescent material layer including red, green and blue emitting portions. The width of a column electrode is set to be different from others, corresponding to a different portion of the fluorescent material layer covering the column electrode.

4 Claims, 3 Drawing Sheets

PLASMA DISPLAY PANEL

BACKGROUND OF THE INVENTION

The present invention relates to a plasma display panel, particularly to an AC-driven plasma display panel capable of displaying in a matrix manner.

In recent years, with the development of large-scale display apparatus, there is an increasing demand for a thin display apparatus having a small-thickness. Such a thin display apparatus includes for example AC-driven plasma display panel.

FIG. 2 illustrates a conventional AC-driven plasma display panel, which contains a fluorescent material layer capable of fluorescently light-emitting by virtue of electric discharge.

As illustrated in FIG. 2, the conventional AC-driven plasma display panel includes a front substrate 1 and a rear substrate 2, arranged to face each other with a discharge space 7 formed therebetween.

Referring again to FIG. 2, the front substrate 1 has on its inner surface a plurality of row electrode pairs (X,Y) arranged in parallel with one another. A dielectric layer 5 for generating wall charges is formed to cover the plurality of row electrode pairs X,Y. Further, a protection layer 6 made of MgO is formed to protect the dielectric layer 5.

Each pair of the row electrodes X,Y includes a pair of transparent electrodes 4,4 consisting of a transparent electrically conductive film, a pair of bus electrodes 3,3 (metal electrode) each consisting of laminated metal layers for improving the conductivity of the transparent electrodes 4,4.

Further referring to FIG. 2, the rear substrate 2 has on its inner surface a plurality of ribs 10 which are arranged in a direction orthogonal to the row electrode pairs X,Y, and thus the discharge space 7 is divided into a plurality of elongate sub-spaces. Each elongate sub-space accommodates a column electrode A (address electrode) arranged in a direction orthogonal to the row electrode pairs X,Y. In addition, a fluorescent material layer 8 including three primary colours (Red, Green, Blue) is provided to cover the ribs 10 and the column electrodes A.

Then, a discharge gas containing neon and small amount of xenon is sealed into the discharge space. Thus, a plurality of picture elements (discharge cells) are formed by intersections of the row electrode pairs (X,Y) with the column electrodes A.

The conventional AC-driven plasma display panel shown in FIG. 2 is operated in the following manner.

At first, reset pulses are applied to all the row electrode pairs to effect an electric discharge between each row electrode pair X,Y. After the electric discharge is over, wall charges are formed so as to be accumulated in the discharge cells.

Next, picture element data pulses are applied to the column electrodes A, a scanning pulse (selective erasing pulse) is applied to one electrode of each row electrode pair X,Y, so as to effect an electric discharge between the column electrodes A and the row electrodes X,Y, selectively erasing the wall charges, thereby selecting lighting cells and non-lighting cells.

Afterwards, maintenance pulses are alternatively applied to the row electrode pairs, so that only the lighting cells having remaining wall charges undergo repeated discharge emission. Then, erasing pulses are applied to the row electrode pairs so as to erase wall charges. In this way, a picture may be displayed by repeating the above process.

However, in the above discharge cells (including Red discharge cells, Green discharge cells and Blue discharge cells), initial voltages (VR, VG, VB) for starting electric discharge between the column electrodes A and the row electrodes are usually different due to different fluorescent materials and the different thicknesses thereof, as shown in FIG. 3. As a result, a common address margin a for Red discharge cells, Green discharge cells and Blue discharge cells, will become narrower and mistaken discharge will become more often, resulting in a deteriorated display characteristic.

SUMMARY OF THE INVENTION

It is an object of the present invention to provide an improved plasma display panel having an improved display characteristic, so as to solve the above-mentioned problems peculiar to the above-mentioned prior art.

According to the present invention, there is provided a plasma display panel which comprises a plasma display panel comprises a front substrate; a plurality of row electrodes provided on an inner surface of the front substrate; a dielectric layer provided on the inner surface of the front substrate so as to cover the row electrodes; a rear substrate spaced apart from the front substrate to form a discharge space therebetween; a plurality of column electrodes provided on an inner surface of the rear substrate; a fluorescent material layer covering the column electrodes, said fluorescent material layer including red, green and blue emitting portions. The width of a column electrode is set to be different from others, corresponding to a different portion of the fluorescent material layer covering the column electrode.

According to one aspect of the present invention, the width of a column electrode covered by a portion of the fluorescent material layer which produces a high initial voltage for starting electric discharge between a column electrode and a row electrode, is made larger than the width of a column electrode covered by one of any other portions of the fluorescent material layer.

The above objects and features of the present invention will become more understood from the following description with reference to the accompanying drawings.

DETAILED DESCRIPTION OF THE PREFERRED EMBODIMENTS

Figure 1:
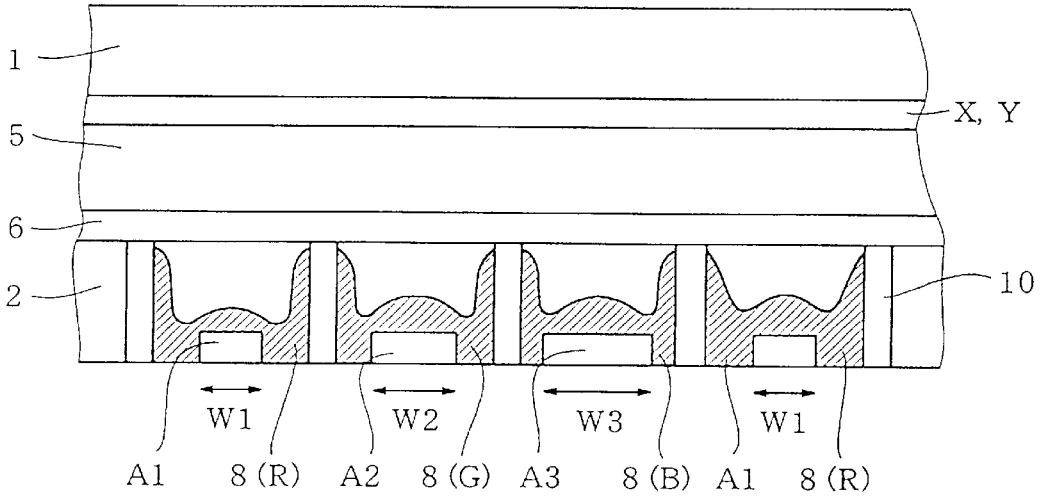
FIG. 1 is a cross sectional view illustrating the structure of a plasma display panel according to the present invention.

The present invention will be described in detail below with reference to the accompanying drawing, in which the same elements as those in the figures of prior art are represented by the same reference numerals.

Referring to FIG. 1, a plasma display panel of the present invention includes a front substrate 1 and a rear substrate 2, both of which are facing each other with a discharge space formed therebetween.

Referring again to FIG. 1, the front substrate 1 has on its inner surface a plurality of row electrode pairs (X,Y) arranged in parallel with one another. A dielectric layer 5 for the formation of wall charges is formed covering the plurality of row electrode pairs X,Y. Further, a protection layer 6 made of MgO is formed to protect the dielectric layer 5.

Each row electrode pair X,Y includes a pair of transparent electrodes consisting of a transparent electrically conductive film, a pair of bus electrodes (metal electrodes) each consisting of laminated metal layers for improving the conductivity of the transparent electrodes.

Further referring to FIG. 1, the rear substrate 2 has on its inner surface a plurality of ribs 10 which are arranged in a direction orthogonal to the row electrode pairs X,Y, and thus the discharge space has been divided into a plurality of elongate sub-spaces. The elongate sub-spaces accommodate column electrodes A1, A2 and A3 (address electrodes) arranged in a direction orthogonal to the row electrode pairs X,Y. In addition, a fluorescent material layer 8 including three primary colours (Red, Green, Blue) is provided to cover the ribs 10 and the column electrodes A1–A3.

Then, a discharge gas containing neon and small amount of xenon is sealed into the discharge space. Thus, a plurality of picture elements (discharge cells) are formed by intersections of the row electrodes pairs (X,Y) with the column electrodes A.

Figure 2:
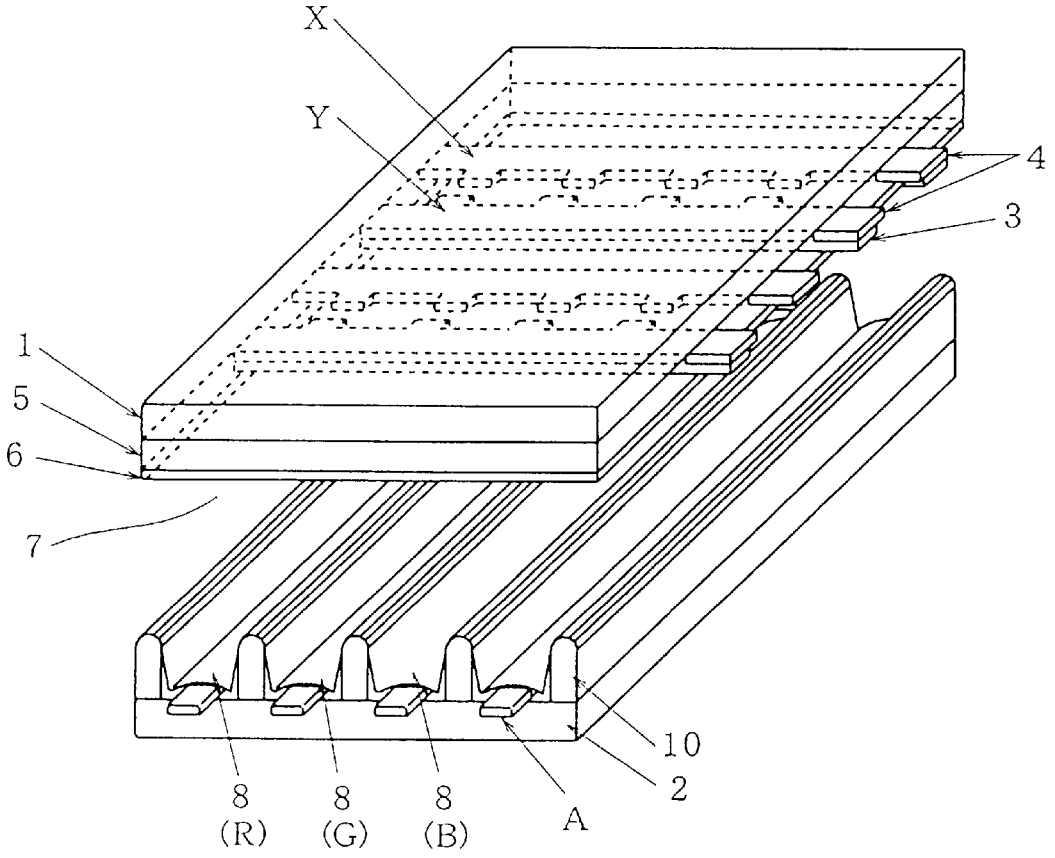
FIG.2 PRIOR ART
FIG. 2 is a cross sectional view illustrating the structure of a conventional plasma display panel.
Figure 3:
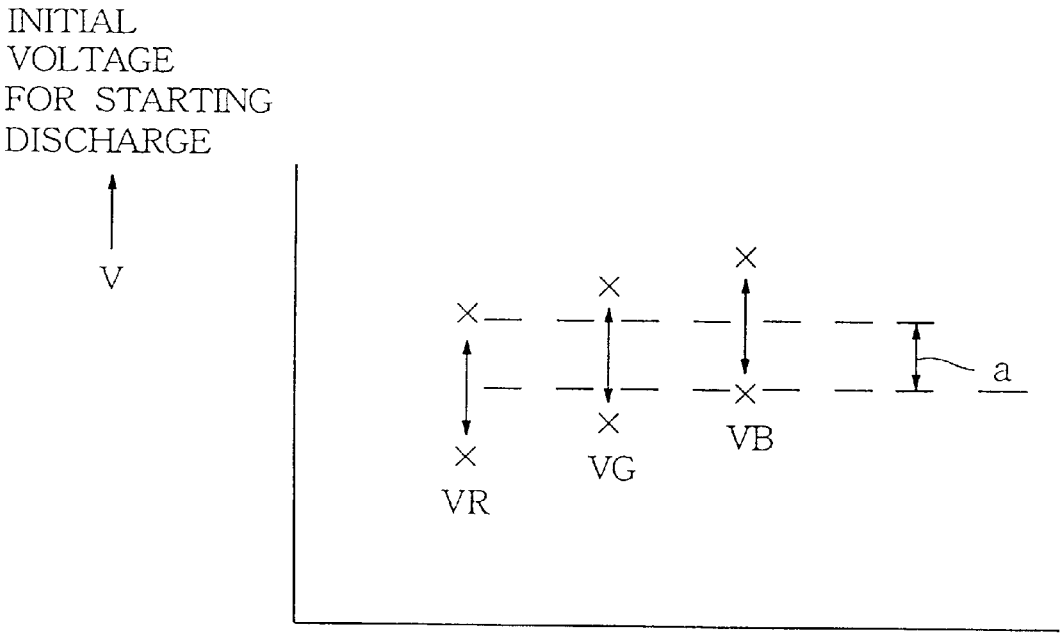
FIG.3 PRIOR ART
FIG. 3 is a graph indicating initial voltages for starting discharges in Red discharge cells, Green discharge cells and Blue discharge cells in the conventional plasma display panel of FIG. 2.

The plasma display panel of FIG. 1 in which the column electrodes A1, A2, A3 have widths W1, W2, W3, is basically the same as that shown in FIG. 2. However, an important difference between the structure shown in FIG. 1 (present invention) and that shown in FIG. 2 (prior art) is that at least one of the column electrodes A1–A3 had its width W1, W2 or W3 made different from the others.

The above AC-driven plasma display panel shown in FIG. 1 may be operated in the following manner.

At first, reset pulses are applied to all the row electrode pairs to effect an electric discharge between each row electrode pair X,Y. After the electric discharge is over, wall charges are formed so as to be accumulated in the discharge cells.

Next, picture element data pulses are applied to the column electrodes A, a scanning pulse is applied to one electrode of each row electrode pair X,Y, so as to effect an electric discharge between the column electrodes A and the row electrodes X,Y, selectively erasing the wall charges, thereby selecting lighting cells and non-lighting cells.

Afterwards, maintenance pulses are alternatively applied to the row electrode pairs, so that only the lighting cells having remaining wall charges undergo repeated discharge emission. Then, erasing pulses are applied to the row electrode pairs so as to erase wall charges. In this way, a picture may be displayed by repeating the above process.

It is known that an initial voltage for starting discharge between a row electrode and a column electrode will vary with the width of a column electrode. Namely, when a column electrode has a large width, an initial voltage for starting discharge between the column electrode and a row electrode will be low. On the other hand, when a column electrode has a small width, the initial voltage for starting such a discharge will be high. This principle has therefore been used in the present invention In the plasma display panel of the present invention, an initial voltage for starting discharge between a column electrode and a row electrode will behave differently in different portions of the fluorescent material layer 8. In detail, an initial voltage in a red fluorescent portion 8 (R) is lower than an initial voltage in a green fluorescent portion 8(G). An initial voltage in a green fluorescent portion 8(G) is further lower than an initial voltage in a blue fluorescent portion 8(B). Accordingly, a width W1 of a column electrode covered by a red fluorescent portion 8(R) is set to be smaller than a width W2 of a column electrode covered by a green fluorescent portion 8(G). A width W2 of a column electrode covered by a green fluorescent portion 8(G) is set to be further smaller than a width W3 of a column electrode covered by a blue fluorescent portion 8(B).

With the effect of the above arrangement, in the discharge cells (including red discharge cells, green discharge cells and blue discharge cells), initial voltages for starting electric discharges between the column electrodes A and the row electrodes X,Y may be made substantially the same to one another. As a result, a common address margin a for red discharge cells, green discharge cells and blue discharge cells will become wider than that in a conventional plasma display panel, thereby ensuring an improved display characteristic for a plasma display panel.

In using the present invention, the width of a column electrode is set to be different from others, corresponding to a different portion of the fluorescent material layer covering the column electrode. Therefore, initial voltages for starting electric discharges between the column electrodes and the row electrodes may be controlled to a substantially same value. As a result, a common address margin a for red discharge cells, green discharge cells and blue discharge cells will be kept wider as compared with a conventional plasma display panel, thereby greatly alleviating problems possibly caused by mistaken discharge, thus ensuring an improved display characteristic for a plasma display panel.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. A plasma display panel comprising:

a front substrate;

a plurality of row electrodes provided on an inner surface of the front substrate;

a dielectric layer provided on the inner surface of the front substrate so as to cover the row electrodes;

a rear substrate spaced apart from the front substrate to form a discharge space therebetween;

a plurality of column electrodes provided on an inner surface of the rear substrate;

a fluorescent material layer covering the column electrodes, said fluorescent material layer including red, green and blue emitting portions;

wherein the width of a column electrode is set to be different from others, corresponding to a different portion of the fluorescent material layer covering the column electrode.

2. The plasma display panel according to claim 1, wherein the width of a column electrode covered by a portion of the fluorescent material layer which produces a high initial voltage for starting discharge between a column electrode and a row electrode, is made larger than the width of a column electrode covered by one of any other portions of the fluorescent material layer.

3. The plasma display panel according to claim 1, wherein the width of the column electrode covered by a red fluorescent material layer is smaller than the width of the column electrode covered by a green fluorescent material layer.

4. The plasma display panel according to claim 3, wherein the width of the column electrode covered by the green fluorescent material layer is smaller than the width of the column electrode covered by a blue fluorescent material layer.

* * * * *